US007369646B2

(12) United States Patent
Dittrich et al.

(10) Patent No.: US 7,369,646 B2
(45) Date of Patent: May 6, 2008

(54) ROTATING ENVELOPE X-RAY RADIATOR

(75) Inventors: Ronald Dittrich, Forchheim (DE); Jörg Freudenberger, Eckental (DE); Detlef Mattern, Erlangen (DE); Peter Röhrer, Bubenreuth (DE); Peter Schardt, Höchstadt (DE)

(73) Assignee: Siemens Aktiengesellschaft, Munich (DE)

( * ) Notice: Subject to any disclaimer, the term of this patent is extended or adjusted under 35 U.S.C. 154(b) by 72 days.

(21) Appl. No.: 11/512,458

(22) Filed: Aug. 29, 2006

(65) Prior Publication Data

US 2007/0058785 A1 Mar. 15, 2007

(30) Foreign Application Priority Data

Aug. 29, 2005 (DE) ..... 10 2005 040 856

(51) Int. Cl.
*H01J 35/00* (2006.01)

(52) U.S. Cl. ..... 378/130; 378/141; 378/200

(58) Field of Classification Search ..... 378/119, 378/121, 125, 127, 130, 141, 199, 200
See application file for complete search history.

(56) References Cited

U.S. PATENT DOCUMENTS

| | | | | |
|---|---|---|---|---|
| 5,703,926 | A | 12/1997 | Bischof | 378/200 |
| 6,045,307 | A | 4/2000 | Ikoma et al. | 409/199 |
| 6,364,527 | B1 | 4/2002 | Kutschera | 378/200 |
| 6,426,998 | B1 | 7/2002 | Hell et al. | 378/141 |
| 7,025,502 | B2 | 4/2006 | Freudenberger et al. | 378/200 |
| 2005/0185761 | A1 | 8/2005 | Freudenberger et al. | 378/127 |

FOREIGN PATENT DOCUMENTS

| | | |
|---|---|---|
| DE | 103 19 735 A1 | 12/2004 |
| DE | 103 35 664 B3 | 6/2005 |
| EP | 1 047 100 A2 | 1/1995 |

*Primary Examiner*—Courtney Thomas
(74) *Attorney, Agent, or Firm*—Schiff Hardin LLP

(57) ABSTRACT

A rotating envelope radiator has a radiator housing surrounded by an external housing to form an intervening space in which a coolant flows. To prevent the formation, at high rotational frequencies, of reverse flows of the coolant in the intervening space, a flow conductor structure is provided in the intervening space that counteracts the formation of tangential flow components in the coolant.

20 Claims, 7 Drawing Sheets

ROTATING ENVELOPE X-RAY RADIATOR

BACKGROUND OF THE INVENTION

1. Field of the Invention

The invention concerns a rotating envelope x-ray radiator.

2. Description of the Prior Art

A rotating envelope radiator is described in DE 196 12 698 C1. A cathode and an anode are permanently mounted inside a vacuum-sealed radiator housing (envelope). The tube is mounted such that it can rotate. An electron beam directed from the cathode to the anode is deflected by a magnetic deflection device that is stationary relative to the tube so that the beam is held stationary in the deflected position. The radiator housing is provided with a cooling device for dissipation of the heat formed by the deceleration of the electron beam in the anode. For example, the cooling device can be an external housing surrounding the radiator housing. For dissipation of the heat a coolant (for example insulating oil) circulates by means of a pump in an intervening space formed between the external housing and the radiator housing.

Furthermore, from DE 103 19 735 A1 a rotating envelope radiator is known that has a radiator housing that is surrounded by an external housing. The radiator housing is mounted by bearings that are arranged in the housing, such that the radiator housing can rotate around an axis. The radiator housing thus rotates in the stationary housing. A coolant is supplied and led away in an intervening space formed between the external housing and the radiator housing, with the coolant circulating around the outside of the radiator housing. In order to counteract the formation of transverse eddies in the coolant, recesses are arranged on an outside surface of the radiator housing that is located in contact with the coolant. The recesses are groove-shaped on the outside surface and proceed in the circumferential direction of the radiator housing. The recesses are concentrically arranged on the facing surfaces.

Further rotating envelope radiators are known from DE 199 29 655 A1 and the corresponding U.S. Pat. No. 6,426,998 as well as from DE 103 35 664 B3 and from DE 10 2004 003 370 A1.

In practice, in operation at high rotational frequencies of the tube of more than 200 revolutions/minute, a significant increase of the power of the pump for circulation of the coolant is required to maintain sufficient cooling. Given an increase of the power of the pump it is also observed that the transport of the coolant sometimes significantly slows or even completely comes to a standstill in a region of the anode that is highly thermally loaded. An unwanted severe heating of the anode can occur as a result.

SUMMARY OF THE INVENTION

An object of the present invention is to provide a rotating envelope radiator that avoids the aforementioned disadvantages, that embodies a cooling arrangement that ensures safe and reliable cooling at high rotational frequencies.

This object is achieved in accordance with the invention by a rotating envelope radiator having a tube mounted such that it can rotate around an axis, the tube having a piston-like radiator housing with a base at which the anode is located. The radiator housing is provided with a cooling device through which coolant can flow, and the cooling device, at least in the region of the base, has a flow conductor structure that counteracts the formation of tangential flow components in the coolant.

It has been shown that an excellent cooling can be ensured even at high rotational frequencies of the tube by the relatively simply achievable measure of the cooling device embodying (at least in the region of the base) a flow conductor structure that counteracts the formation of tangential flow components in the coolant. According to the present state of knowledge, that is attributed to the fact that a tangential deflection (due to the Coriolis force (Coriolis acceleration)) of the current in the coolant is significantly reduced or suppressed by the provision of the aforementioned flow conductor structure. Formation of unwanted reverse (blocking) flows in the coolant (which require a significant power increase of the pump to overcome) does not occur. An unwanted slowing or standstill of the transport of the coolant thus can be counteracted.

In an embodiment, the flow conductor structure is provided in radial segments of the cooling device extending essentially radially. "Radial segments" as used herein means surfaces of the cooling device that intersect the axis. It is in these segments that formation of the unwanted reverse flows due to the Coriolis force occurs. The inventive flow conductor structures thus are provided on the outside of the radiator housing in the region of the base as well as possibly in a middle segment of the radiator housing in a region with a small diameter.

In a further embodiment the flow conductor structure extends over a significant section of the surface of the radial segments. This means that the flow conductor structures extend over a significant amount a radius of the surface(s) of the radial segment(s) (these surfaces generally being annular).

In a particularly simple embodiment, the flow conductor structure is formed by radially proceeding webs. The webs can be interrupted. They can extend over only one segment of the surface. They can also be a component of labyrinthine structures that extend in the radial direction. The flow conductor structure also can be formed, for example, from suitably-directed conduits surrounding the outside of the radiator housing.

In a particularly simply designed embodiment, the cooling device has an external housing surrounding the radiator housing at least in segments, such that an intervening space through which coolant can flow is formed between the radiator housing and the external housing. In this case the flow conductor structure is provided on an inside of the external housing facing the radiator housing. In a rotating envelope radiator so designed, the radiator housing thus forms the vacuum housing and the external housing forms the coolant housing rotating with the vacuum housing.

For further improvement of the dissipation of heat from the anode, an outside of the radiator housing facing the external housing exhibits grooves and/or webs (which preferably proceed radially) at least in a region of the base. The surface to be cooled is thereby enlarged on the outside of the radiator housing and accelerates the heat discharge. In addition, it is possible for the flow conductor structure to have a number of elements that are essentially regularly arranged in the surface and proceed axially, for example cylindrical rods or the like.

In a further embodiment the flow conductor structure has a porous or foam-like material in the intervening space, through which coolant can flow. The material can be any of porous sintered metal, metal foam, porous ceramic, or ceramic foam. This material enables a particularly simple realization of the flow conductor structure.

In a further embodiment the external housing can be produced from at least two parts, with one of the two parts being a cover mounted in the region of the base. Furthermore, the external housing can be formed by two housing half-shells located in a middle section of the radiator housing. The use of the such housing half-shells is particularly suitable for radiator housings that exhibit a smaller diameter in their middle section than the bases situated opposite one another. In this case the external housing can also have a second cover that is mounted on a further base of the radiator housing that is situated opposite the aforementioned base. In this embodiment, the external housing can essentially be formed by four parts on whose inner sides (which face the radiator housing) suitable flow conductor structures are provided, at least in the radial segments thereof. The cooling device according to the invention can be realized in a simple and cost-effective manner by a simple mounting and fixed connection of the external housing with the radiator housing.

In a further embodiment, the external housing is made of plastic, preferably a plastic reinforced with glass fibers, carbon fibers or synthetic fibers. The external housing also can be made of PEEK. The external housing can be connected with a drive for setting the radiator housing into rotational movement. A suitable structure for powered coupling with the drive can be provided for this purpose on the external housing. For example, the coupling can be circumferential teeth for engagement with a toothed belt, or recesses or projections for engagement in a coupling provided on the drive, or the like.

DESCRIPTION OF THE PREFERRED EMBODIMENTS

Figure 1:
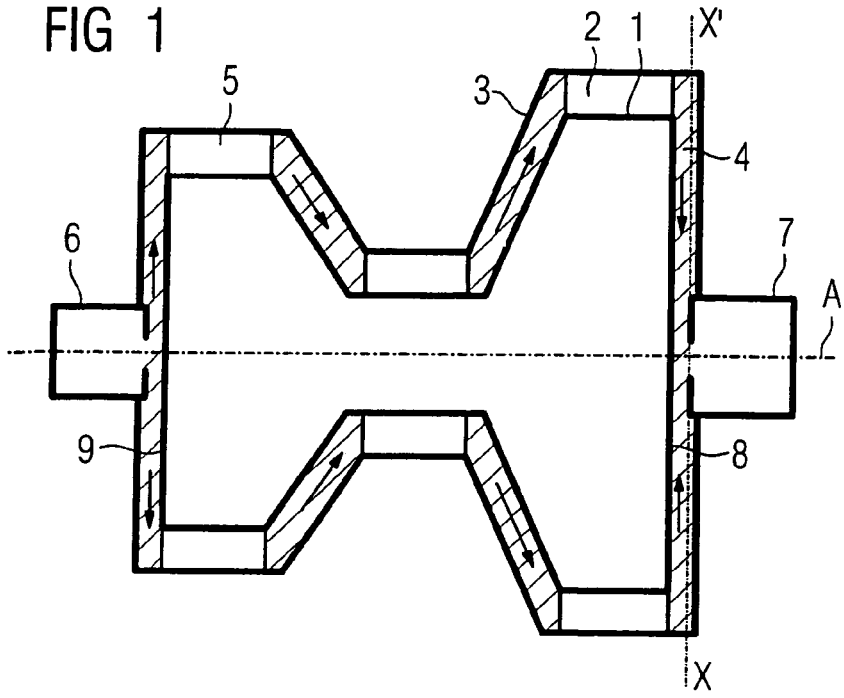
FIG. 1 is a schematic sectional view of a first embodiment of a rotating envelope radiator in accordance with the invention.

FIG. 1 shows a schematic sectional view through a first rotating envelope radiator. The rotating envelope radiator has a radiator housing 1 that can rotate around an axis A. The radiator housing 1 is connected in a fixed manner with an external housing 3 to form an intervening space 2. The intervening space 2 exhibits radial segments 4 that extend essentially radially, the radial segments 4 being shown hatched in FIG. 1. Furthermore the intervening space 2 includes casing segments 5 that are shown white in FIG. 1. The intervening space 2 is provided with a coolant inlet 6 for supply of coolant (for example insulating oil or water). The radiator housing 1 therewith forms the vacuum housing and the external housing 3 forms the coolant housing rotating with the vacuum housing.

The radiator housing 1 (produced from metal or another suitable material and vacuum-sealed) is fashioned like a piston and, in the region of a base 8, has an anode (not shown) connected in a fixed manner with the radiator housing 1. A cathode (not shown) is provided in the region of an opposite further base 9.

Figure 2:
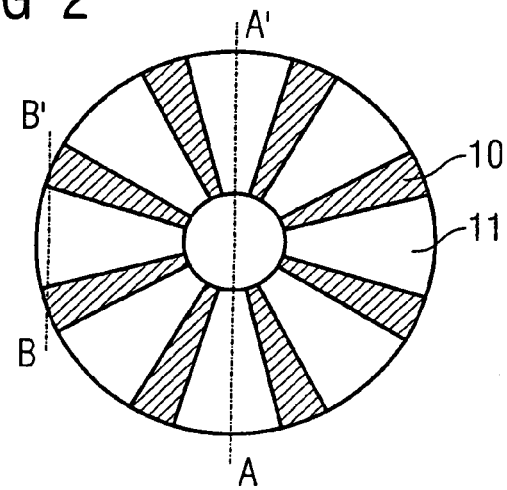
FIG. 2 is a schematic plan view taken along the section line X-X' in FIG. 1.

FIG. 2 shows a schematic sectional view along the section line X-X' in FIG. 1. A flow conductor structure formed by radially-proceeding webs 10 and cooling channels 11 located in between the webs 10 is provided in the intervening space 2.

Figure 3:
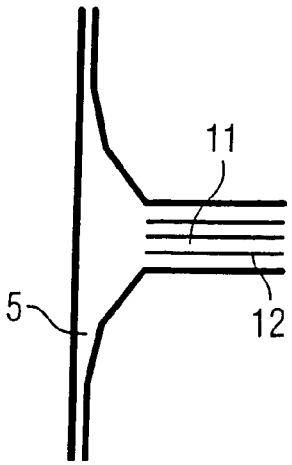
FIG. 3 is a schematic sectional view taken along the section line A-A' in FIG. 2.
Figure 4:
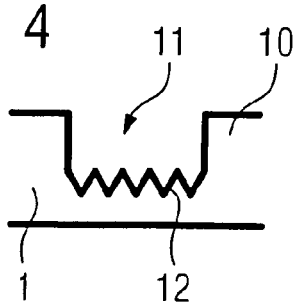
FIG. 4 is a schematic detail of a portion of the structure of FIG. 3.

As can be seen from FIG. 3, the cooling channels 11 can extend radially outwardly into the casing segment 5 in the region of the junction. As is shown in FIG. 4, the cooling channels 11 can be provided with ribs 12 on their side facing toward the radiator housing 1. The ribs 12 enlarge the surface to be cooled and the effectiveness of the heat transfer to the coolant is therewith increased.

Figure 5A:
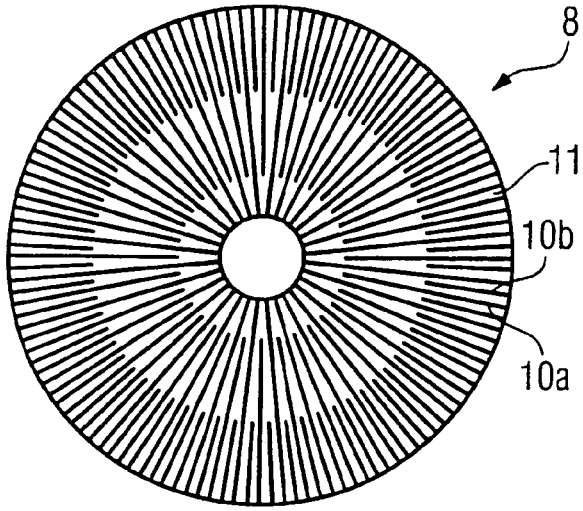
FIGS. 5*a*-5*f* respectively show embodiments of flow conductor structures according to the invention.

FIGS. 5*a* through 5*f* show various variants of flow conductor structures in the region of the base 8. In FIG. 5*a* first webs 10*a* are provided that extend radially over a significant section of the base 8. In contrast to this, second webs 10*b* extend only over a radially outer section of the base 8.

Figure 5B:
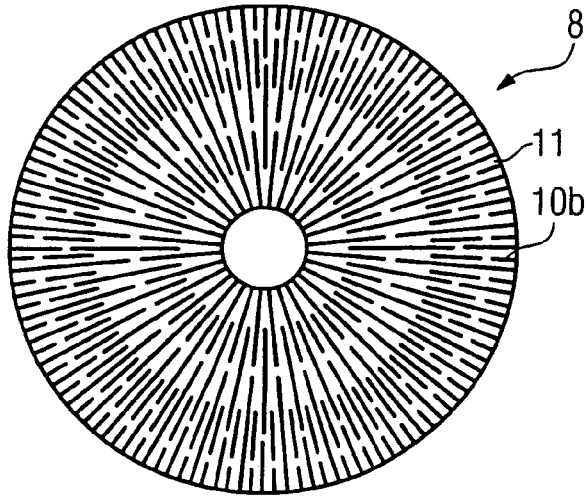
Figure 5C:
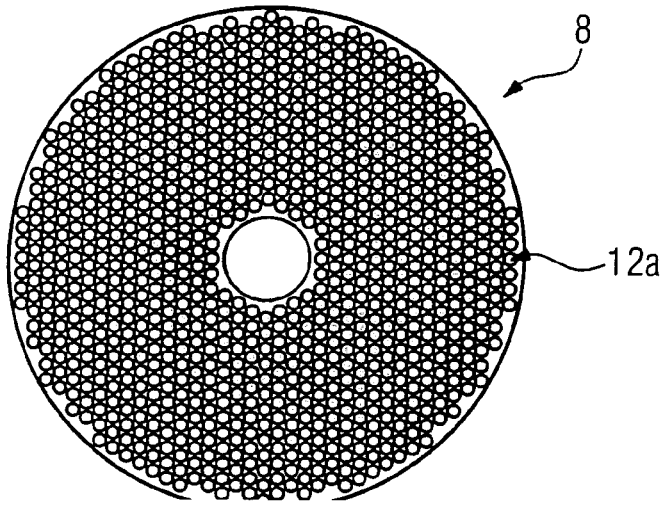

In the variant shown in FIG. 5*b* the first webs 10*a* and the second webs 10*b* are interrupted.

Figure 5D:
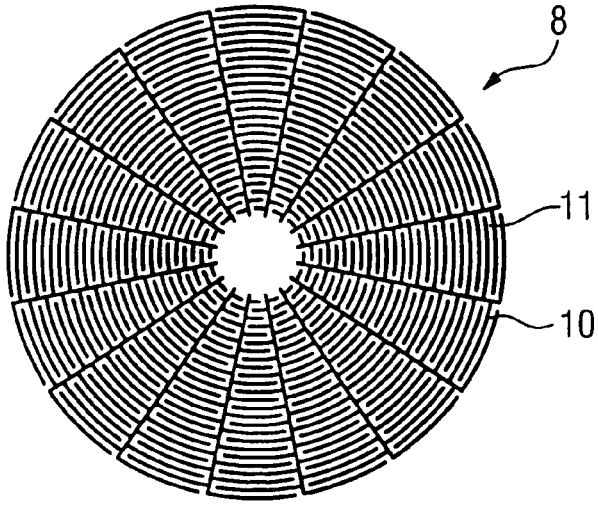
Figure 5E:
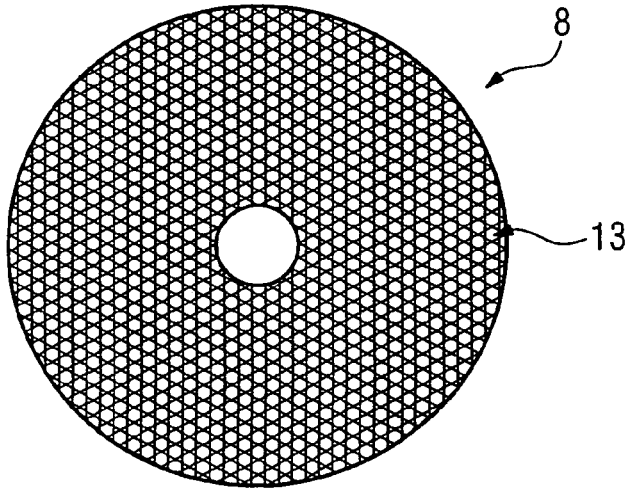

As shown in FIG. 5*d*, the webs 10 can also proceed in a labyrinthine manner. The formation of tangential flow vectors in the intervening space 2 can also be counteracted with this structure and moreover a particularly effective transfer of heat to the coolant can be achieved.

Figure 5F:
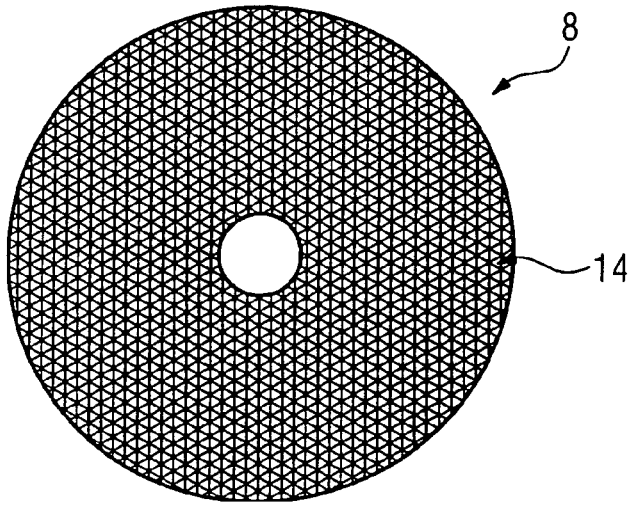

Suitable flow conductor structures can also be generated by the use of axially-proceeding cylindrical rods 12*a* (FIG. 5*c*) (in a hexagonal symmetry), by hexagonal saw structures 13 (FIG. 5*e*) or also triangular saw structures 14 (FIG. 5*f*).

FIGS. 6*a* through 6*f* show partial cross-section views perpendicular to the radially-proceeding flow conductor structures of FIGS. 5*a*-5*f*. An outside 15 of the radiator housing 1 facing toward the external housing 3 is roughened. Such a roughing can be generated, for example, by sandblasting or other suitable techniques. The roughening also can be in the form of radial grooves (as designated with reference character 12 in FIG. 4).

Figure 6A:
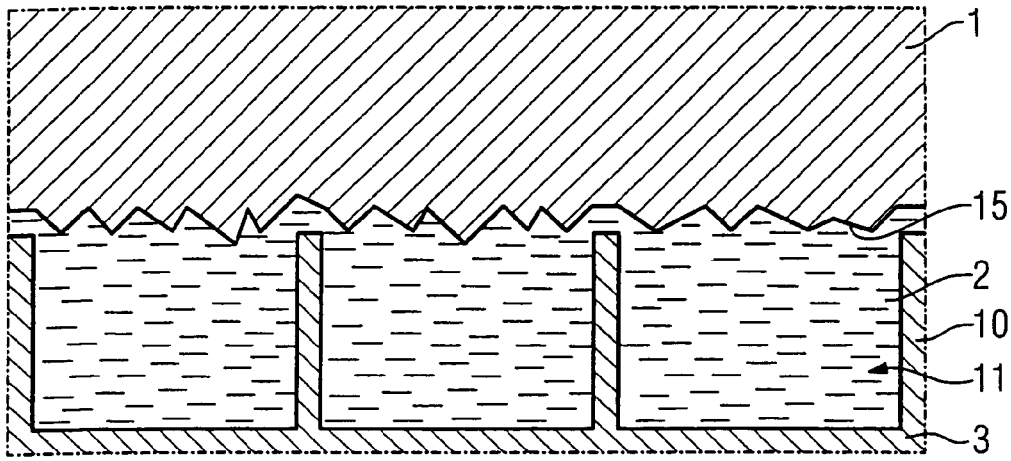
FIGS. 6*a*-6*f* respectively are schematic partial sectional views taken perpendicular to embodiments of the flow conductor structures of FIGS. 5*a*-5*f*.
Figure 6B:
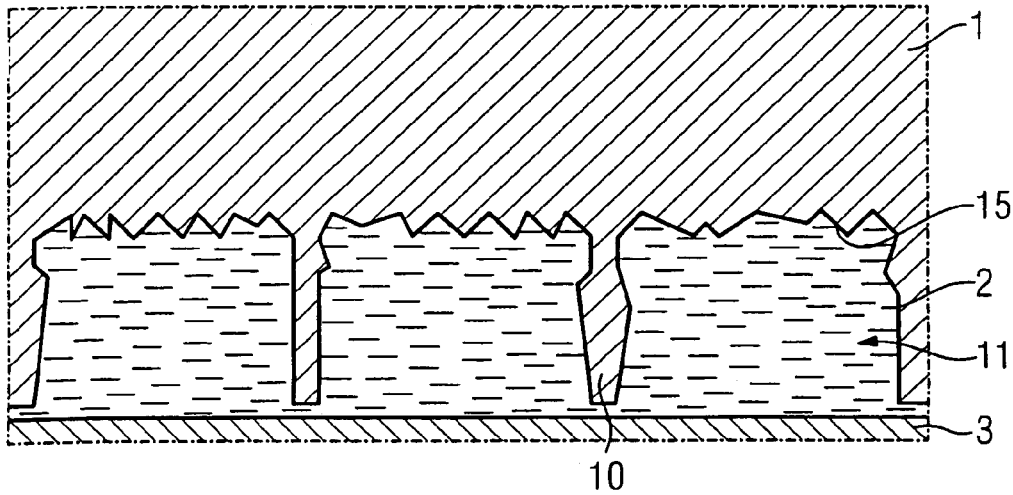
Figure 6C:
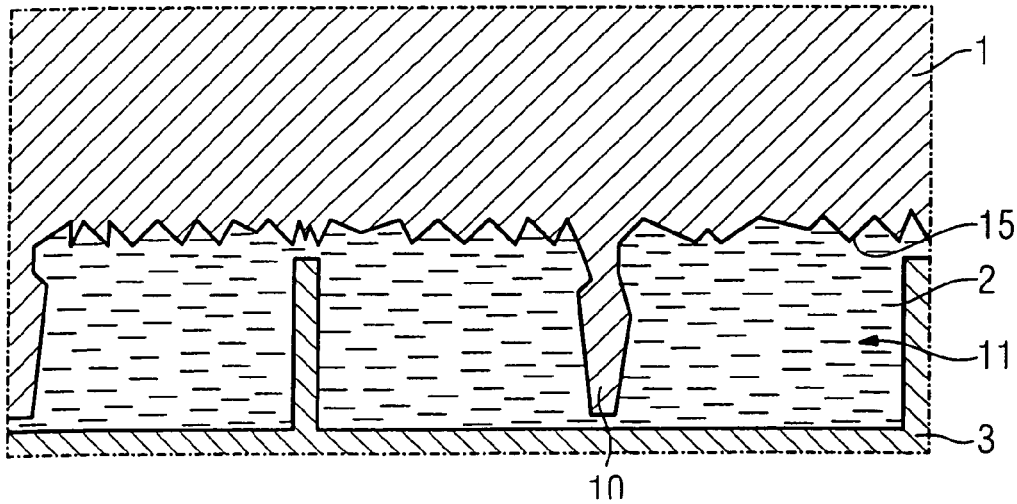
Figure 6D:
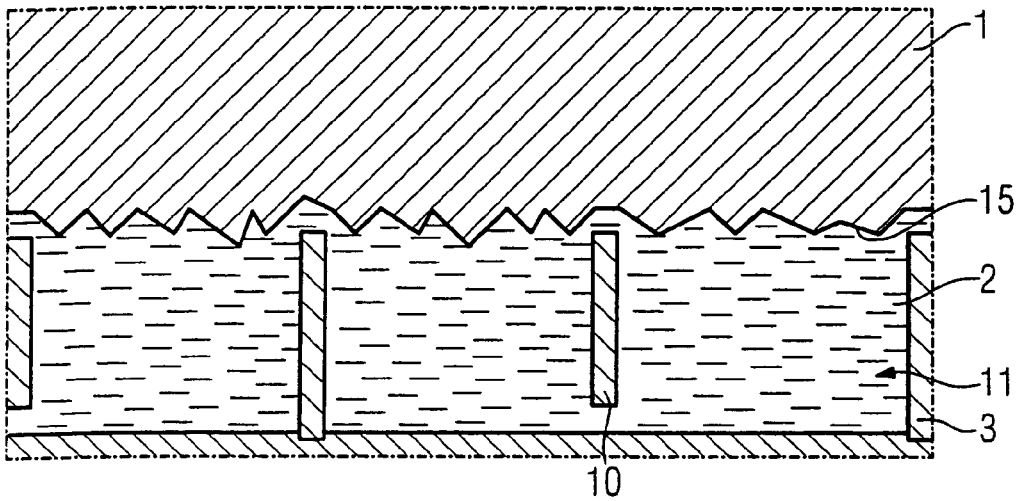

As can be seen from FIGS. 6*a* through 6*c*, the webs 10 can be attached on the external housing 3, on the radiator housing 1 or both on the external housing 3 and on the radiator housing 1. It is additionally possible for the webs 10 to be self-supporting (cantilevered), i.e. as a type of spoke extending through the intervening space 2 (see FIG. 6*d*).

Figure 6E:
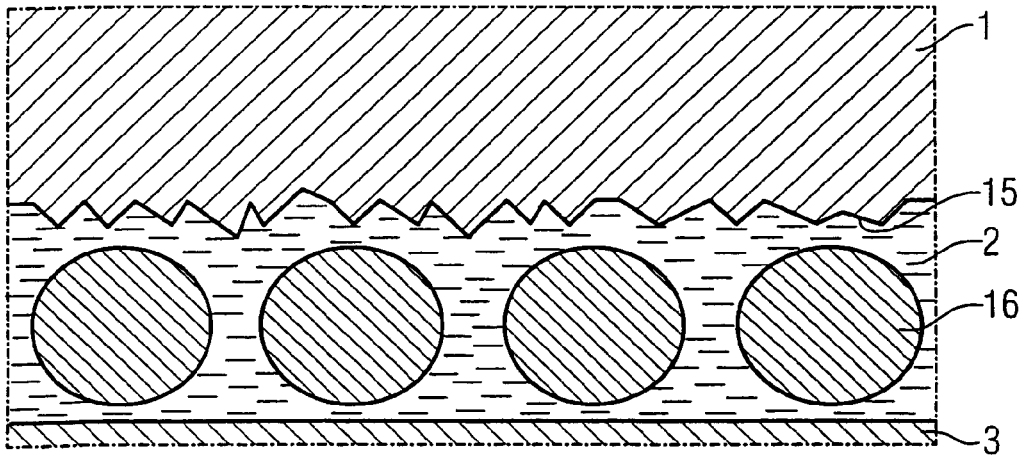
Figure 6F:
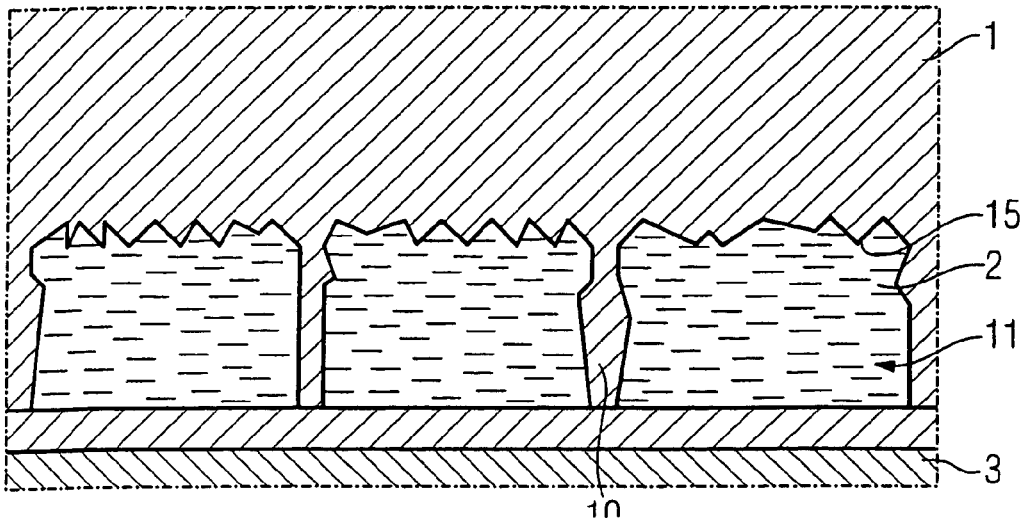

Instead of the webs 10, self-supporting rods 16 can extend in the radial direction through the intervening space 2 (see FIG. 6*e*). In the variant shown in FIG. 6*f* the flow conductor structure is a component of the radiator housing 1.

Figure 7:
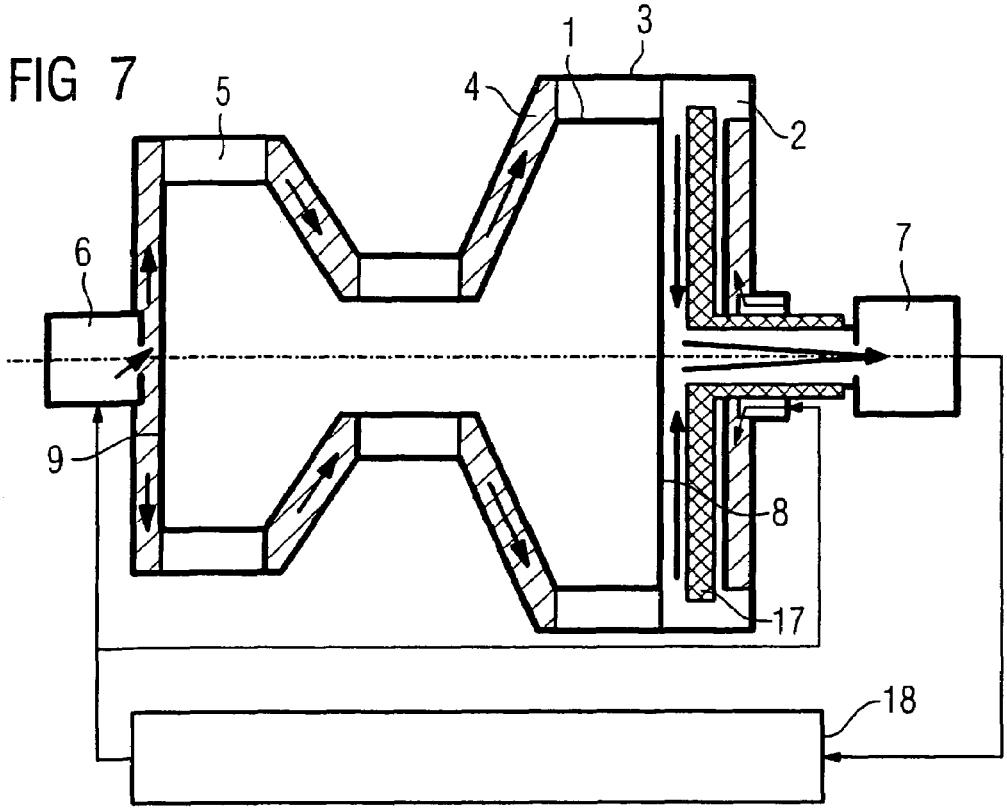
FIG. 7 is a schematic sectional view of a second embodiment of a rotating envelope radiator in accordance with the invention.

FIG. 7 shows a schematic cross-sectional view of a second embodiment of the rotating envelope radiator. In the intervening space 2 that is formed between the base 8 and the opposite segment of the external housing 3, a disc 17 is provided that can rotate relative to the radiator housing 1 and the external housing 4 connected therewith in a fixed manner. The disc 17, for example, can be held stationary given rotation of the radiator housing 1 or of the external housing 3. It can also be rotated with a lower rotation speed than the radiator housing 1 in the same direction or in the opposite direction. The disc 17 consequently leads to a flow formation that forces the coolant in the direction of the coolant outlet 7. By suitable formation of the disc 17 or suitable relative movements of the disc 17 with respect to the radiator housing 1, the use of a pump for transport of the coolant can be omitted. The coolant is supplied from the coolant outlet 7 through a heat exchanger 18, and back to the coolant inlet 6 again.

Figure 8:
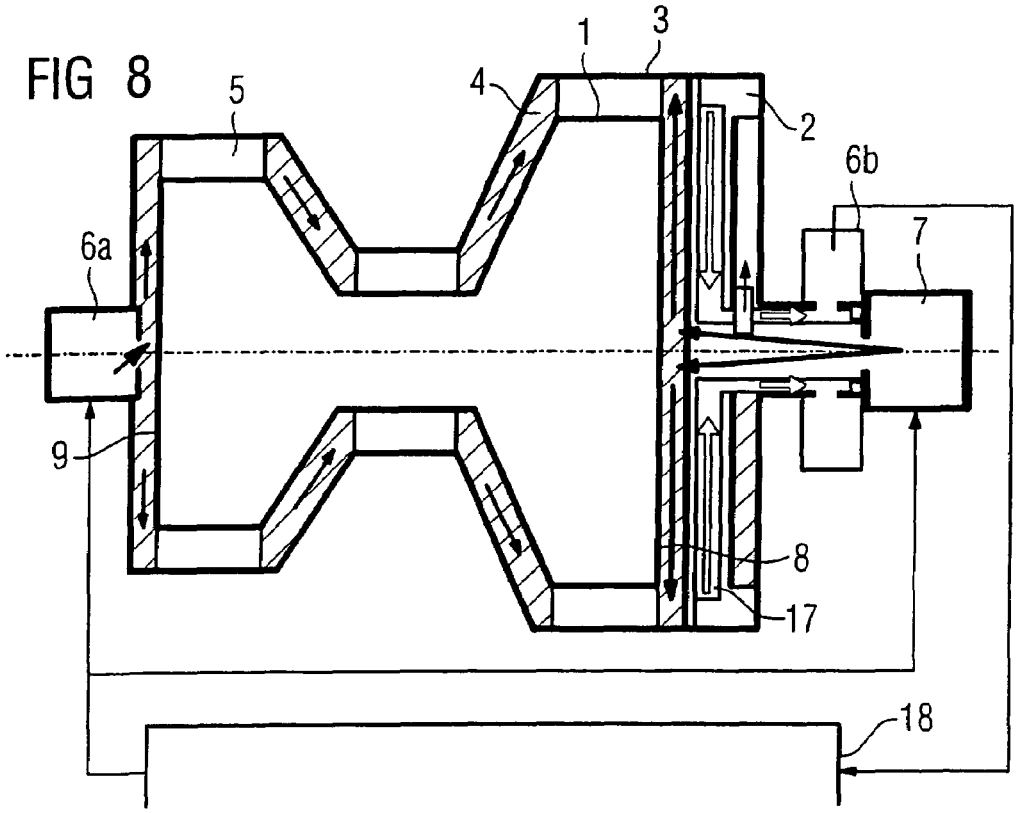
FIG. 8 is a schematic sectional view of a third embodiment for rotating envelope radiator in accordance with the invention.

In the third embodiment of the rotating envelope radiator shown in FIG. 8, the disc 17 is in the form of a double plate. A particularly strong flow of the coolant in the direction of the coolant outlet 7 can be achieved with this structure. In the embodiment shown in FIG. 8 a further coolant inlet 6 is provided in the region of the coolant outlet 7. This allows coolant that comes directly from the heat exchanger 18 to be supplied without prior heating to the region of the base 8 of the rotating envelope radiator that is particularly severely heated in operation.

Figure 9:
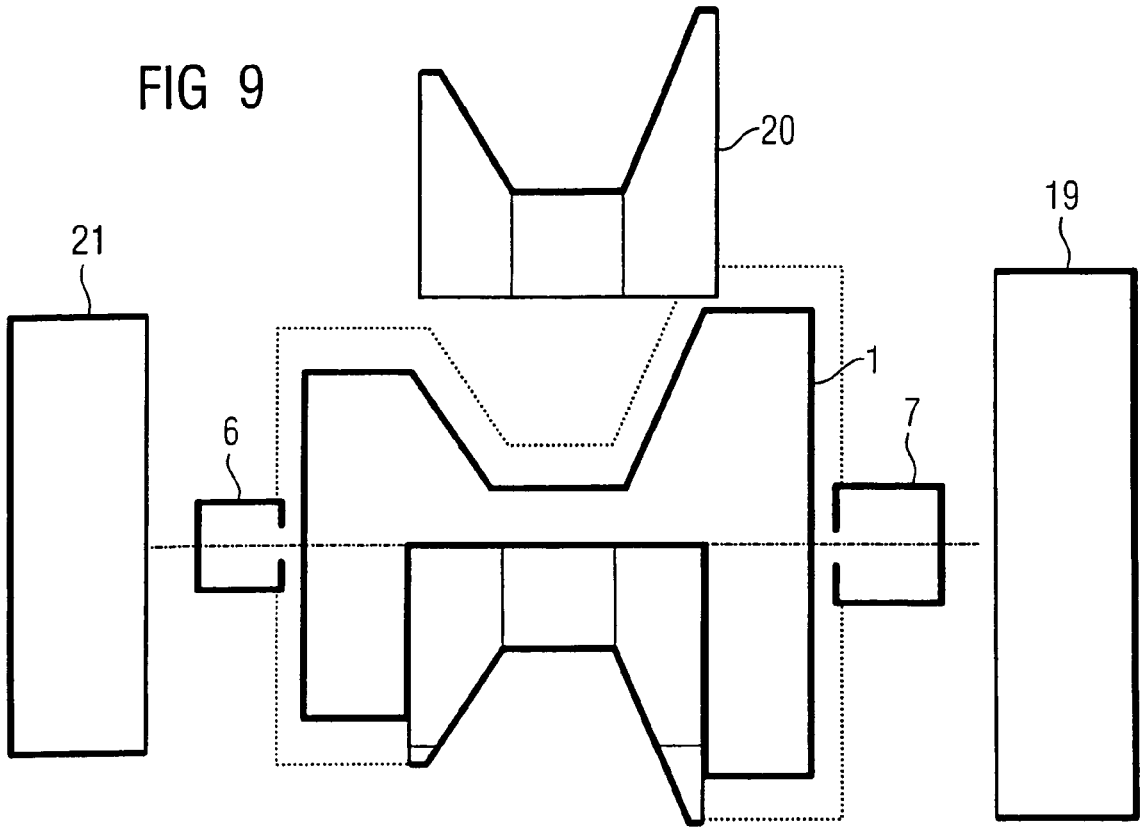
FIG. 9 is a schematic section view of an embodiment of the external housing of a rotating envelope radiator in accordance with the invention.

FIG. 9 shows an embodiment for production of the external housing. The external housing 3 can accordingly be produced from a first cover 19, two middle housing half-shells 20 as well as a second cover 21. The aforementioned housing components can be produced, for example, from a plastic such as PEEK or the like. They can be connected with one another by suitable mounting arrangements or by adhesion.

Figure 10:
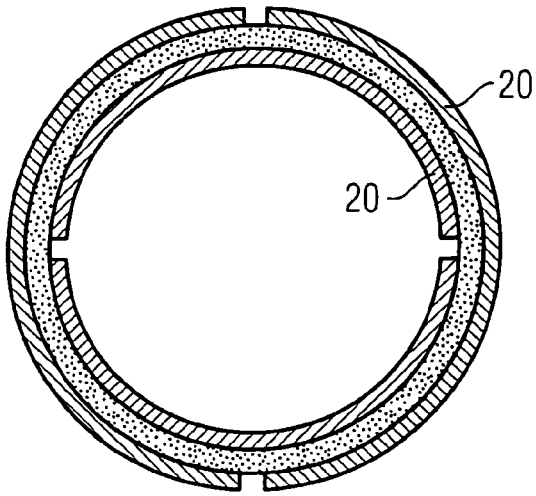
FIG. 10 is a schematic sectional view taken transverse to the housing shells in the embodiment of FIG. 9.

As can be seen from FIG. 10, a number of the middle housing half-shells 20 shown in FIG. 9 can be connected atop one another with an offset by 90° and affixed by gluing. A particularly pressure-resistant formation of the external housing 3 is thereby achieved.

Although modifications and changes may be suggested by those skilled in the art, it is the intention of the inventors to embody within the patent warranted hereon all changes and modifications as reasonably and properly come within the scope of their contribution to the art.

We claim as our invention:

1. A rotating envelope x-ray radiator comprising:

a rotatably mounted x-ray tube having a piston-like radiator housing having a base at which an anode is disposed;

said radiator housing comprising a cooling device in which coolant flows; and said cooling device, at least in a region of said base, comprising a flow conductor structure that counteracts formation of tangential flow components in said coolant as said radiator housing rotates.

2. A rotating envelope x-ray radiator as claimed in claim 1 wherein said cooling device comprises radial segments that proceeds substantially radially from an axis of rotation of said radiator housing, and wherein said flow conductor structure is disposed in said radial segments of said cooling device.

3. A rotating envelope x-ray radiator as claimed in claim 2 wherein said flow conductor structure extends over a substantial section of a surface of the radial segments.

4. A rotating envelope x-ray radiator as claimed in claim 1 wherein said flow conductor structure comprises webs proceeding radially from an axis of rotation of said radiator housing.

5. A rotating envelope x-ray radiator as claimed in claim 1 wherein said cooling device comprises an external housing surrounding at least a portion of said radiator housing, and being spaced therefrom to form an intervening space through which said coolant flows.

6. A rotating envelope x-ray radiator as claimed in claim 5 wherein said flow conductor structure is disposed at an interior of said external housing, facing said radiator housing.

7. A rotating envelope x-ray radiator as claimed in claim 6 wherein said radiator housing has an exterior that faces said interior of said external housing, and wherein said flow conductor structure comprises a plurality of flow directing elements disposed at said outside of said radiator housing, and proceeding radially at least in a region of said base, with respect to an axis of rotation of said radiator housing.

8. A rotating envelope x-ray radiator as claimed in claim 7 wherein said flow directing elements are elements selected from the group consisting of grooves in said outside of said radiator housing and webs disposed on said outside of said radiator housing.

9. A rotating envelope x-ray radiator as claimed in claim 5 wherein said flow conductor structure comprises a material disposed in said intervening space through which said coolant flows, said material being selected from the group consisting of porous material and foam material.

10. A rotating envelope x-ray radiator as claimed in claim 9 wherein said material is a material selected from the group consisting of porous sintered metal, metal foam, porous ceramic, and ceramic foam.

11. A rotating envelope x-ray radiator as claimed in claim 5 comprising a disk that is stationary relative to said radiator housing disposed in said intervening space between said base and said external housing.

12. A rotating envelope x-ray radiator as claimed in claim 5 comprising a disk that is rotatable at a different rotational speed with respect to said radiator housing, said disk being disposed in said intervening space between said base and said external housing.

13. A rotating envelope x-ray radiator as claimed in claim 5 wherein said external housing comprising at least two housing parts, with one of said at least two housing parts being a cover mounted in a region of said base.

14. A rotating envelope x-ray radiator as claimed in claim 13 wherein said at least two housing parts further comprise two housing half-shells disposed at a middle of said radiator housing.

15. A rotating envelope x-ray radiator as claimed in claim 5 wherein said base is a first base, and wherein said radiator housing comprises a second base disposed opposite said first base, and wherein said external housing comprises two housing half-shells attached to said second base.

16. A rotating envelope x-ray radiator as claimed in claim 5 wherein said external housing is comprised of plastic.

17. A rotating envelope x-ray radiator as claimed in claim 16 wherein said plastic is a fiber-reinforced plastic, containing fibers selected from the group consisting of glass fibers, carbon fibers, and synthetic fibers.

18. A rotating envelope x-ray radiator as claimed in claim 5 wherein said external housing is comprised of PEEK.

19. A rotating envelope x-ray radiator as claimed in claim 5 comprising a drive for rotating said radiator housing, said drive being in driving connection with said external housing.

20. A rotating envelope x-ray radiator as claimed in claim 1 wherein said coolant is a coolant selected from the group consisting of insulating oil and water.

* * * * *